US010760287B2

(12) United States Patent
Cook et al.

(10) Patent No.: US 10,760,287 B2
(45) Date of Patent: Sep. 1, 2020

(54) LOOSEFILL INSULATION BLOWING MACHINE WITH A FULL HEIGHT BALE GUIDE

(71) Applicant: Owens Corning Intellectual Capital, LLC, Toledo, OH (US)

(72) Inventors: David M. Cook, Granville, OH (US); Todd Jenkins, Newark, OH (US); Ryan S. Crisp, Lewis Center, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1094 days.

(21) Appl. No.: 15/078,491

(22) Filed: Mar. 23, 2016

(65) Prior Publication Data

US 2016/0298341 A1 Oct. 13, 2016

Related U.S. Application Data

(60) Provisional application No. 62/146,527, filed on Apr. 13, 2015.

(51) Int. Cl.
*E04F 21/08* (2006.01)
*B02C 18/22* (2006.01)

(52) U.S. Cl.
CPC ..... *E04F 21/085* (2013.01); *B02C 18/2216* (2013.01); *B02C 18/2291* (2013.01)

(58) Field of Classification Search
CPC .... E04F 21/08; E04F 21/085; B02C 18/2225; B02C 18/2291
USPC ..... 241/60, 98, 280; 222/190, 236
See application file for complete search history.

(56) References Cited

U.S. PATENT DOCUMENTS 2,869,793 A 1/1959 Montgomery
3,051,398 A * 8/1962 Babb ..... B02C 13/06 19/80 R
4,151,962 A 5/1979 Calhoun et al.
4,236,654 A 12/1980 Mello
4,268,205 A * 5/1981 Vacca ..... B65G 53/4633 222/368

(Continued)

FOREIGN PATENT DOCUMENTS

DE 3238492 A1 4/1984
DE 3240126 A1 5/1984

*Primary Examiner* — Shelley M Self
*Assistant Examiner* — Smith Oberto Bapthelus
(74) *Attorney, Agent, or Firm* — MacMillan, Sobanski & Todd, LLC

(57) ABSTRACT

A machine for distributing blowing insulation material from a package of compressed loosefill insulation material is provided. The machine includes a chute. The chute has an inlet portion, an outlet portion, a bale guide and a cutting mechanism. The inlet portion is configured to receive the package with the package having a substantially vertical orientation. The inlet portion has a vertical height. The bale guide has a length and is configured to urge the package against the cutting mechanism. The cutting mechanism is configured to open the package. A lower unit is configured to receive the material exiting the outlet portion of the chute. The lower unit includes a plurality of shredders and a discharge mechanism. The discharge mechanism is configured to discharge conditioned loosefill insulation material into an airstream. The length of the bale guide extends substantially across the height of the inlet portion of the chute.

3 Claims, 6 Drawing Sheets

(56) References Cited

U.S. PATENT DOCUMENTS

| | | | | |
|---|---|---|---|---|
| 4,337,902 | A | 7/1982 | Markham | |
| 4,344,580 | A | 8/1982 | Hoshall et al. | |
| 4,465,239 | A | 8/1984 | Woten | |
| 5,590,984 | A | 1/1997 | Assarsson | |
| 5,639,033 | A * | 6/1997 | Miller | B02C 18/12 241/101.4 |
| 5,669,563 | A | 9/1997 | Gearing et al. | |
| 5,829,649 | A | 11/1998 | Horton | |
| 6,109,488 | A | 8/2000 | Horton | |
| 7,284,715 | B2 | 10/2007 | Dziesinski et al. | |
| D568,458 | S | 5/2008 | Evans et al. | |
| 7,819,349 | B2 * | 10/2010 | Johnson | E04F 21/085 241/101.4 |
| 7,878,435 | B2 | 2/2011 | Johnson et al. | |
| 7,938,348 | B2 | 5/2011 | Evans et al. | |
| 7,980,498 | B2 | 7/2011 | Johnson et al. | |
| 8,191,809 | B2 | 6/2012 | Johnson et al. | |
| 8,272,587 | B2 * | 9/2012 | Johnson | E04F 21/085 241/277 |
| 2010/0230441 | A1 * | 9/2010 | Johnson | E04F 21/085 222/190 |
| 2011/0000990 | A1 * | 1/2011 | Johnson | E04F 21/085 241/60 |
| 2013/0020422 | A1 * | 1/2013 | Bynelius | B02C 18/2291 241/28 |
| 2016/0298341 | A1 * | 10/2016 | Cook | E04F 21/085 |

* cited by examiner

LOOSEFILL INSULATION BLOWING MACHINE WITH A FULL HEIGHT BALE GUIDE

RELATED APPLICATIONS

This application claims priority from U.S. Provisional Patent Application No. 62/146,527, filed Apr. 13, 2015, the disclosure of which is incorporated herein by reference in its entirety.

BACKGROUND

When insulating buildings and installations, a frequently used insulation product is loosefill insulation material. In contrast to the unitary or monolithic structure of insulation materials formed as batts or blankets, loosefill insulation material is a multiplicity of discrete, individual tufts, cubes, flakes or nodules. Loosefill insulation material is usually applied within buildings and installations by blowing the loosefill insulation material into an insulation cavity, such as a wall cavity or an attic of a building. Typically loosefill insulation material is made of glass fibers although other mineral fibers, organic fibers, and cellulose fibers can be used.

Loosefill insulation material, also referred to as blowing wool, is typically compressed in packages for transport from an insulation manufacturing site to a building that is to be insulated. Typically the packages include compressed loosefill insulation material encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of loosefill insulation material into an insulation cavity typically uses an insulation blowing machine that can condition the loosefill insulation material to a desired density and feed the conditioned loosefill insulation material pneumatically through a distribution hose. Blowing insulation machines typically have a funnel-shaped chute or hopper for containing and feeding the blowing insulation material after the package is opened and the blowing insulation material is allowed to expand.

It would be advantageous if insulation blowing machines could be improved to make them easier to use.

SUMMARY

The above objects as well as other objects not specifically enumerated are achieved by a machine for distributing blowing insulation material from a package of compressed loosefill insulation material. The machine includes a chute configured to receive the package of compressed loosefill insulation material. The chute has an inlet portion, an outlet portion, a bale guide and a cutting mechanism. The inlet portion is configured to receive the package of compressed loosefill insulation material with the package having a substantially vertical orientation. The inlet portion of the chute has a vertical height. The bale guide has a length and is configured to urge the package against the cutting mechanism as the package slides within the chute. The cutting mechanism is configured to open the bag of insulation. A lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream. The length of the bale guide extends substantially across the height of the inlet portion of the chute.

There is also provided a machine for distributing blowing loosefill insulation material from a package of compressed loosefill insulation material. The machine includes a chute configured to receive the package of compressed loosefill insulation material. The chute has an inlet portion, an outlet portion, a bale guide and a cutting mechanism. The inlet portion is configured to receive the package of compressed loosefill insulation material with the package having a substantially vertical orientation. The bale guide has a length, a vertical orientation and is configured to urge the package against the cutting mechanism as the package slides within the chute. The cutting mechanism is configured to open the bag of insulation. A lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream. The length of the bale guide is configured to retain the vertical orientation of the package as the package slides within the chute and engages the cutting mechanism.

There is also provided a machine for distributing blowing loosefill insulation material from a package of compressed loosefill insulation material. The machine includes a chute configured to receive the package of compressed loosefill insulation material. The chute has a depth, an inlet portion, an outlet portion, a bale guide and a cutting mechanism. The inlet portion is configured to receive the package of compressed loosefill insulation material with the package having a substantially vertical orientation. The bale guide has a depth, a vertical orientation and is configured to urge the package against the cutting mechanism as the package slides within the chute. The cutting mechanism is configured to open the bag of insulation. A lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream. The depth of the bale guide forms a retention structure configured to retain within the chute loosefill insulation material exiting the package and expanding toward the inlet portion of the chute.

There is also provided a machine for distributing blowing loosefill insulation material from a package of compressed loosefill insulation material. The machine includes a chute configured to receive the package of compressed loosefill insulation material. The chute has a width, an inlet portion, an outlet portion, a bale guide and a cutting mechanism. The inlet portion is configured to receive the package of compressed loosefill insulation material with the package having a substantially vertical orientation. The bale guide extends from the inlet portion of the chute, has a width and is configured to urge the package against the cutting mechanism as the package slides within the chute. The cutting mechanism is configured to open the bag of insulation. A lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream. The width of the bale guide is less than 20.0% of the width of the chute.

Various objects and advantages of the loosefill insulation blowing machine with a full height bale guide will become apparent to those skilled in the art from the following detailed description, when read in light of the accompanying drawings.

DETAILED DESCRIPTION OF THE INVENTION

Figure 1:
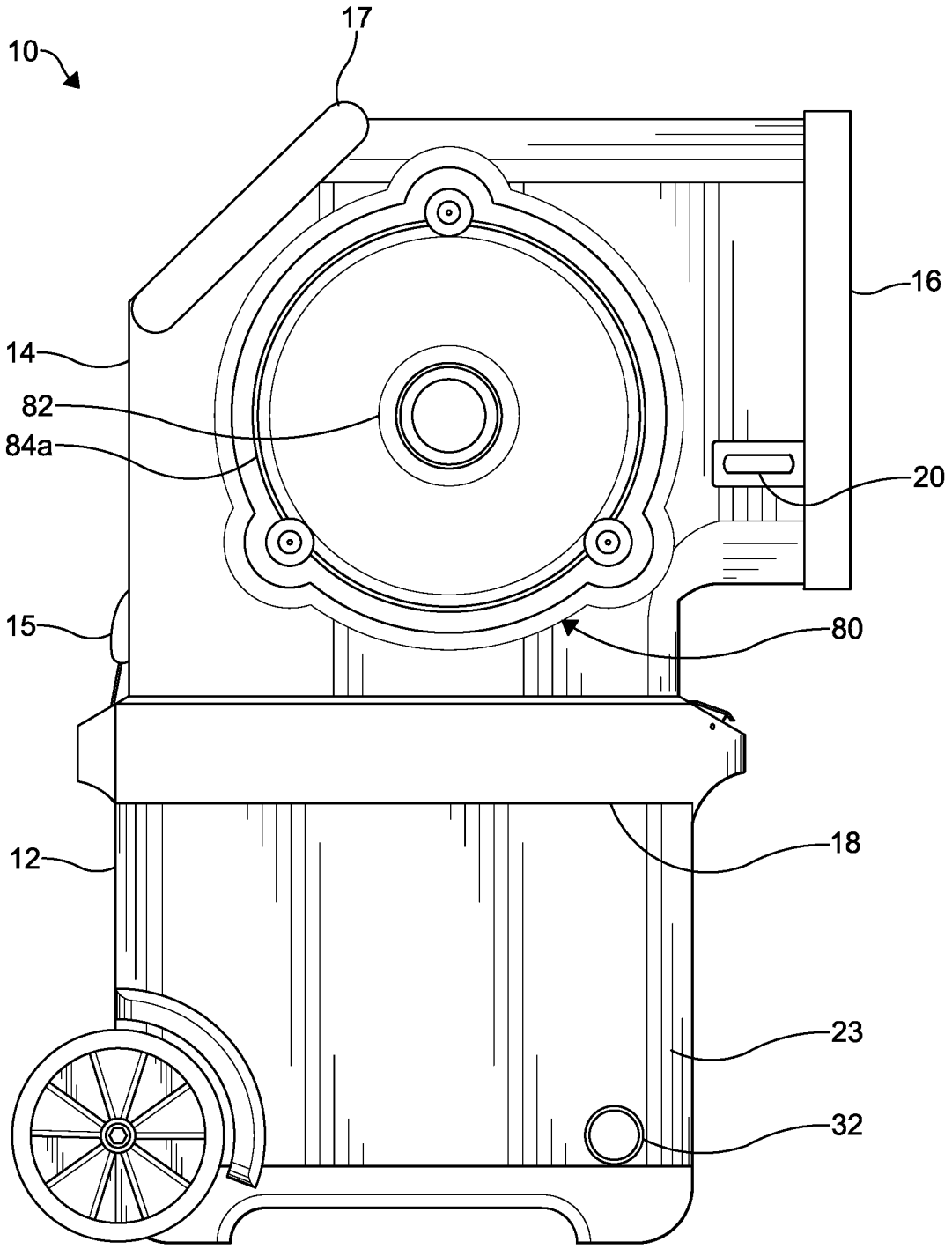
FIG. 1 is a front view, in elevation, of a loosefill insulation blowing machine.

The loosefill insulation blowing machine with a full height bale guide will now be described with occasional reference to specific embodiments. The loosefill insulation blowing machine with a full height bale guide may, however, be embodied in different forms and should not be construed as limited to the embodiments set forth herein. Rather, these embodiments are provided so that this disclosure will be thorough and complete, and will fully convey the scope of the loosefill insulation blowing machine with a full height bale guide to those skilled in the art.

Unless otherwise defined, all technical and scientific terms used herein have the same meaning as commonly understood by one of ordinary skill in the art to which the loosefill insulation blowing machine with a full height bale guide belongs. The terminology used in the description of the loosefill insulation blowing machine with a full height bale guide herein is for describing particular embodiments only and is not intended to be limiting of the loosefill insulation blowing machine with a full height bale guide. As used in the description of the loosefill insulation blowing machine with a full height bale guide and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the loosefill insulation blowing machine with a full height bale guide. Notwithstanding that the numerical ranges and parameters setting forth the broad scope of the loosefill insulation blowing machine with a full height bale guide are approximations, the numerical values set forth in the specific examples are reported as precisely as possible. Any numerical values, however, inherently contain certain errors necessarily resulting from error found in their respective measurements.

The description and figures disclose a loosefill insulation blowing machine with a full height bale guide. The bale guide is positioned within an inlet portion of a chute. The chute configured to receive a package of compressed loosefill insulation material. The bale guide is configured for several functions. First, the bale guide is configured to urge the package of compressed loosefill insulation material against a cutting mechanism as the package is slid into the chute. Next, the bale guide is configured to retain expanding loosefill insulation material within the interior of the chute as the package is cut by the cutting mechanism. Finally, the bale guide is configured to retain the package in an upright orientation as the package engages the cutting mechanism, thereby substantially preventing sagging of the package as the moves past the cutting mechanism.

The term "loosefill insulation material", as used herein, is defined to mean any insulating material configured for distribution in an airstream. The term "finely conditioned", as used herein, is defined to mean the shredding, picking apart and conditioning of loosefill insulation material to a desired density prior to distribution into an airstream.

Figure 2:
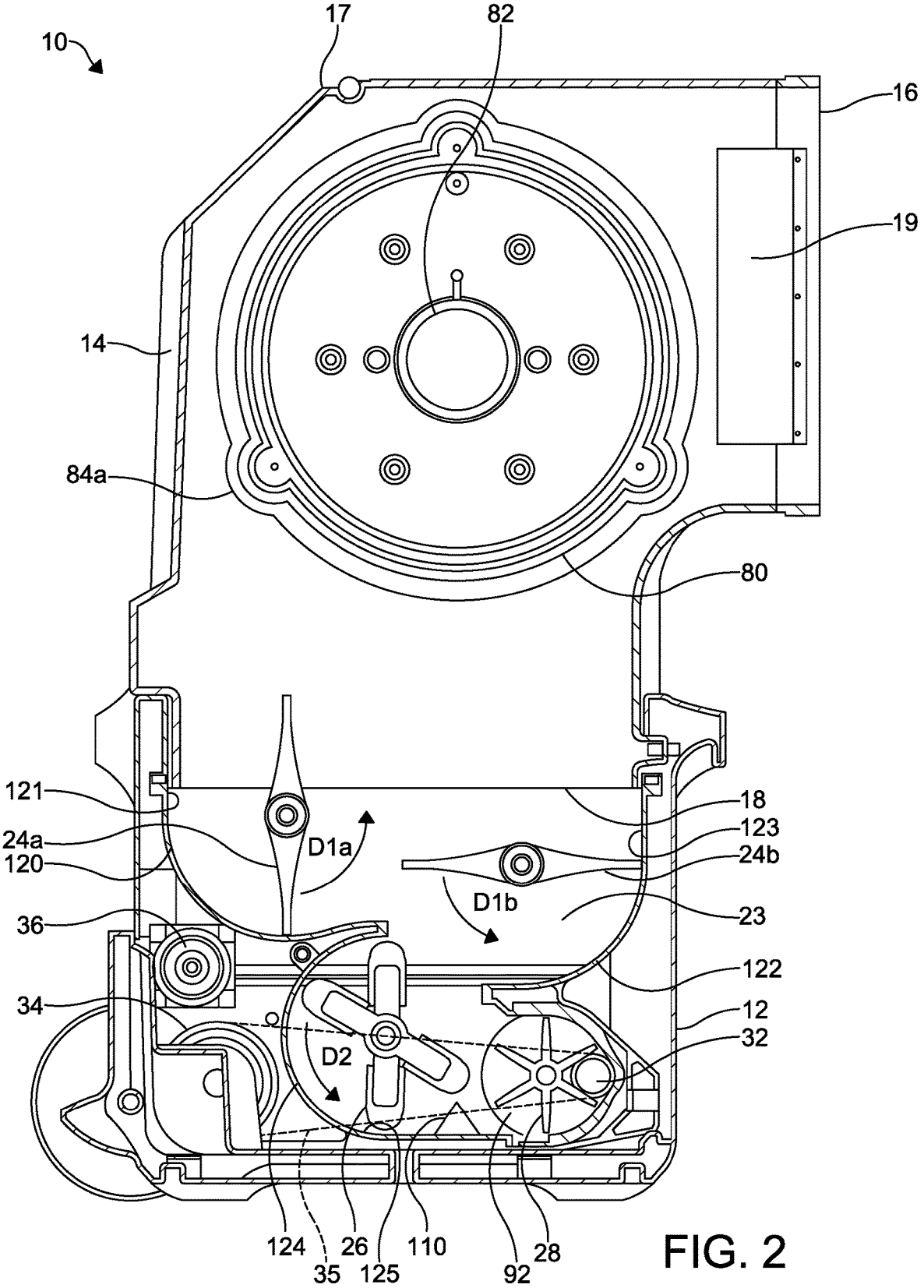
FIG. 2 is a front view, in elevation, partially in cross-section, of the loosefill insulation blowing machine of FIG. 1.
Figure 3:
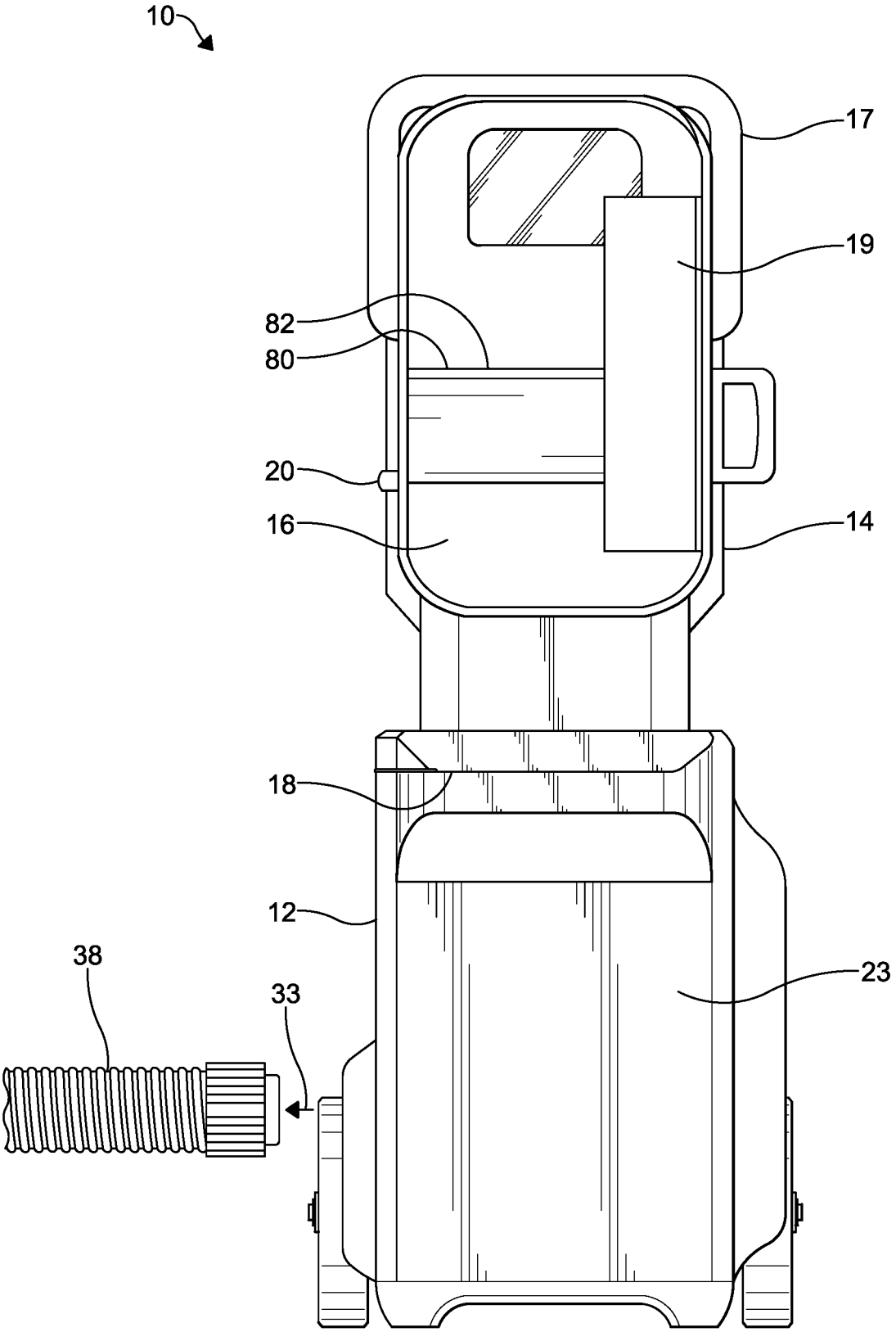
FIG. 3 is a side view, in elevation, of the loosefill insulation blowing machine of FIG. 1.

Referring now to FIGS. 1-3, a loosefill insulation blowing machine (hereafter "blowing machine") is shown generally at 10. The blowing machine 10 is configured for conditioning compressed loosefill insulation material and further configured for distributing the conditioned loosefill insulation material to desired locations, such as for example, insulation cavities. The blowing machine 10 includes a lower unit 12 and a chute 14. The lower unit 12 is connected to the chute 14 by one or more fastening mechanisms 15, configured to readily assemble and disassemble the chute 14 to the lower unit 12. The chute 14 has an inlet portion 16 and an outlet portion 18.

Referring again to FIGS. 1-3, the inlet portion 16 of the chute 14 is configured to receive compressed loosefill insulation material typically contained within a package (not shown). As the package of compressed loosefill insulation material is guided into an interior of the chute 14, the cross-sectional shape and size of the chute 14 relative to the cross-sectional shape and size of the package of compressed loosefill insulation material directs an expansion of the compressed loosefill insulation material to a direction toward the outlet portion 18, wherein the loosefill insulation material is introduced to a shredding chamber 23 positioned in the lower unit 12.

Referring again to FIGS. 1-3, optionally the chute 14 can include one or more handle segments 17, configured to facilitate ready movement of the blowing machine 10 from one location to another. The handle segment 17 can have any desired structure and configuration. However, it should be understood that the one or more handle segments 17 are not necessary to the operation of the blowing machine 10.

Referring again to FIGS. 1-3, the chute 14 includes a bail guide 19, mounted at the inlet portion 16 of the chute 14. The bail guide 19 is configured to urge a package of compressed loosefill insulation material against a cutting mechanism 20 as the package of compressed loosefill insulation material moves further into the interior of the chute 14. The bail guide 19 will be discussed in more detail below.

Referring again to FIGS. 1-3, the chute 14 includes a distribution hose storage structure 80. The distribution hose storage structure 80 is configured to store a distribution hose 38 within the chute 14 in the event the blowing machine 10 is not in use. The distribution hose storage structure 80 includes a hose hub 82 attached to flanges 84*a*, 84*b*, with each of the flanges 84*a*, 84*b* being mounted in opposing sides of the chute 14.

Referring now to FIG. 2, the shredding chamber 23 is mounted in the lower unit 12, downstream from the outlet portion 18 of the chute 14. The shredding chamber 23 can include a plurality of low speed shredders 24*a*, 24*b* and one or more agitators 26. The low speed shredders 24*a*, 24*b* are configured to shred, pick apart and condition the loosefill insulation material as the loosefill insulation material is discharged into the shredding chamber 23 from the outlet portion 18 of the chute 14. The one or more agitators 26 are configured to finely condition the loosefill insulation material to a desired density as the loosefill insulation material exits the low speed shredders 24*a*, 24*b*. It should be appreciated that any quantity of low speed shredders and agitators can be used. Further, although the blowing machine 10 is described with low speed shredders and agitators, any type or combination of separators, such as clump breakers, beater bars or any other mechanisms, devices or structures that shred, pick apart, condition and/or finely condition the loosefill insulation material can be used.

Referring again to the embodiment shown in FIG. 2, the agitator 26 is positioned vertically below the low speed shredders 24*a*, 24*b*. Alternatively, the agitator 26 can be positioned in any location relative to the low speed shredders 24*a*, 24*b*, such as horizontally adjacent to the low speed shredders 24*a*, 24*b*, sufficient to finely condition the loosefill insulation material to a desired density as the loosefill insulation material exits the low speed shredders 24*a*, 24*b*.

In the embodiment illustrated in FIG. 2, the low speed shredders 24*a*, 24*b* rotate in a counter-clockwise direction, as shown by direction arrows D1*a*, D1*b* and the one or more agitators 26 also rotate in a counter-clockwise direction, as shown by direction arrow D2. Rotating the low speed shredders 24*a*, 24*b* and the agitator 26 in the same counter-clockwise directions, D1*a*, D1*b* and D2, allows the low speed shredders 24*a*, 24*b* and the agitator 26 to shred and pick apart the loosefill insulation material while substantially preventing an accumulation of unshredded or partially shredded loosefill insulation material in the shredding chamber 23. However, in other embodiments, the low speed shredders 24*a*, 24*b* and the agitator 26 could rotate in a clock-wise direction or the low speed shredders 24*a*, 24*b* and the agitator 26 could rotate in different directions provided an accumulation of unshredded or partially shredded loosefill insulation material does not occur in the shredding chamber 23.

Referring again to the embodiment shown in FIG. 2, the low speed shredders 24*a*, 24*b* rotate at a lower rotational speed than the agitator 26. The low speed shredders 24*a*, 24*b* rotate at a speed of about 40-80 revolutions per minute (rpm) and the agitator 26 rotates at a speed of about 300-500 rpm. In another embodiment, the low speed shredders 24*a*, 24*b* can rotate at a speed less than about 40-80 rpm, provided the speed is sufficient to shred and pick apart the loosefill insulation material. In still other embodiments, the agitator 26 can rotate at a speed less than or more than 300-500 rpm provided the speed is sufficient to finely shred the loosefill insulation material and prepare the loosefill insulation material for distribution into an airstream.

Referring again to FIG. 2, the shredding chamber 23 includes a first guide shell 120 positioned partially around the low speed shredder 24*a*. The first guide shell 120 extends to form an arc of approximately 90°. The first guide shell 120 has an inner surface 121. The first guide shell 120 is configured to allow the low speed shredder 24*a* to seal against the inner surface 121 and thereby direct the loosefill insulation material in a downstream direction as the low speed shredder 24*a* rotates.

Referring again to FIG. 2, the shredding chamber 23 includes a second guide shell 122 positioned partially around the low speed shredder 24*b*. The second guide shell 122 extends to form an arc of approximately 90°. The second guide shell 122 has an inner surface 123. The second guide shell 122 is configured to allow the low speed shredder 24*b* to seal against the inner surface 123 and thereby direct the loosefill insulation material in a downstream direction as the low speed shredder 24*b* rotates.

Referring again to FIG. 2, the shredding chamber 23 includes a third guide shell 124 positioned partially around the agitator 26. The third guide shell 124 extends to form an approximate semi-circle. The third guide shell 124 has an inner surface 125. The third guide shell 124 is configured to allow the agitator 26 to seal against the inner surface 125 and thereby direct the finely conditioned loosefill insulation material in a downstream direction as the agitator 26 rotates.

In the embodiment shown in FIG. 2, the inner surfaces 121, 123 and 125, are formed from a high density polyethylene material (hdpe) configured to provide a lightweight, low friction sealing surface and guide for the loosefill insulation material. Alternatively, the inner surfaces 121, 123 and 125 can be formed from other materials, such as aluminum, sufficient to provide a lightweight, low friction sealing surface and guide that allows the low speed shredders 24*a*, 24*b* and the agitator 26 to direct the loosefill insulation material downstream.

Referring again to FIG. 2, a discharge mechanism, shown schematically at 28, is positioned downstream from the one or more agitators 26 and is configured to distribute the finely conditioned loosefill insulation material exiting the agitator 26 into an airstream, shown schematically by arrow 33 in FIG. 3. In the illustrated embodiment, the discharge mechanism 28 is a rotary valve. In other embodiments, the discharge mechanism 28 can be other structures, mechanisms and devices, such as for example staging hoppers, metering devices or rotary feeders, sufficient to distribute the finely conditioned loosefill insulation material into the airstream 33.

Referring again to FIG. 2, the finely conditioned loosefill insulation material is driven through the discharge mechanism 28 and through a machine outlet 32 by the airstream 33. The airstream 33 is provided by a blower 34 and associated ductwork, shown in phantom at 35. In alternate embodiments, the airstream 33 can be provided by other structures and manners, such as by a vacuum, sufficient to provide the airstream 33 through the discharge mechanism 28.

Referring again to FIG. 2, the low speed shredders 24*a*, 24*b*, agitator 26 and discharge mechanism 28 are mounted for rotation. In the illustrated embodiment, they are driven by an electric motor 36 and associated drive means (not shown). However, in other embodiments, the low speed shredders 24*a*, 24*b*, agitator 26 and discharge mechanism 28 can be driven by any suitable means. In still other embodiments, each of the low speed shredders 24*a*, 24*b*, agitator 26 and discharge mechanism 28 can be provided with its own source of rotation. In the illustrated embodiment, the electric motor 36 driving the low speed shredders 24*a*, 24*b*, agitator 26 and discharge mechanism 28 is configured to operate on a single 15 ampere, 110 volt a.c. electrical power supply. In other embodiments, other suitable power supplies can be used.

Referring again to FIG. 2, the discharge mechanism 28 is configured with a side inlet 92. The side inlet 92 is configured to receive the finely conditioned loosefill insulation material as it is fed in a substantially horizontal direction from the agitator 26. In this embodiment, the side inlet 92 of the discharge mechanism 28 is positioned to be horizontally adjacent to the agitator 26. In another embodiment, a low speed shredder 24*a* or 24*b*, or a plurality of low speed shredders 24*a*, 24*b* or agitators 26, or other shredding mechanisms can be horizontally adjacent to the side inlet 92 of the discharge mechanism 28 or in other suitable positions.

Referring again to FIG. 2, a choke 110 is positioned between the agitator 26 and the discharge mechanism 28. In this position, the choke 110 is configured to allow finely conditioned loosefill insulation material to enter the side inlet 92 of the discharge mechanism 28 and redirect heavier clumps of conditioned loosefill insulation material past the side inlet 92 of the discharge mechanism 28 and back to the low speed shredders, 24*a* and 24*b*, for further conditioning. In the illustrated embodiment, the choke 110 has a substantially triangular cross-sectional shape. However, the choke 110 can have other cross-sectional shapes sufficient to allow finely conditioned loosefill insulation material to enter the side inlet 92 of the discharge mechanism 28 and redirect heavier clumps of conditioned loosefill insulation material past the side inlet 92 of the discharge mechanism 28 and back to the low speed shredders, 24*a* and 24*b*, for further conditioning.

Referring again to FIG. 2, in operation, the inlet portion 16 of the chute 14 receives a package of compressed loosefill insulation material. As the package of compressed loosefill insulation material moves into the chute 14, the bale guide 19 urges the package against the cutting mechanism 20 thereby cutting an outer protective covering and allowing the compressed loosefill insulation within the package to expand. As the compressed loosefill insulation material expands within the chute 14, the chute 14 directs the expanding loosefill insulation material past the outlet portion 18 of the chute 14 and into the shredding chamber 23. The low speed shredders 24*a*, 24*b* receive the loosefill insulation material and shred, pick apart and condition the loosefill insulation material. The loosefill insulation material is directed by the low speed shredders 24*a*, 24*b* to the agitator 26. The agitator 26 is configured to finely condition the loosefill insulation material and prepare the loosefill insulation material for distribution into the airstream 33 by further shredding and conditioning the loosefill insulation material. The finely conditioned loosefill insulation material exits the agitator 26 and enters the discharge mechanism 28 for distribution into the airstream 33 provided by the blower 34. The airstream 33, entrained with the finely conditioned loosefill insulation material, exits the insulation blowing machine 10 at the machine outlet 32 and flows through the distribution hose 38 toward an insulation cavity (not shown).

Figure 4:
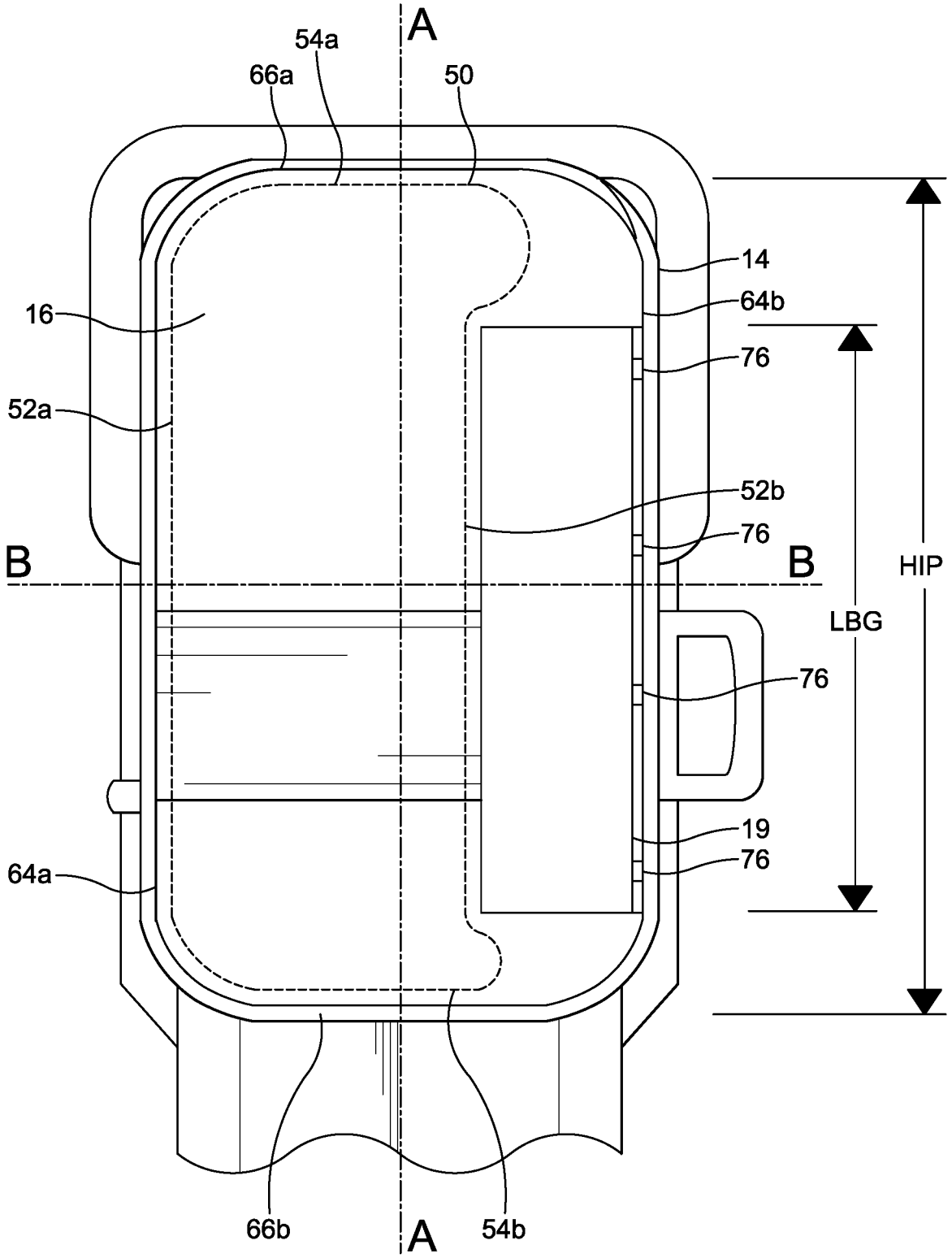
FIG. 4 is a front view, in elevation, of the inlet portion of the chute of the loosefill insulation blowing machine of FIG. 1.

Referring now to FIG. 4, the inlet portion 16 of the chute 14 includes longitudinal sides 64*a*, 64*b* and lateral sides 66*a*, 66*b*. The longitudinal sides 64*a*, 64*b* of the inlet portion 16 of the chute 14, are configured to be substantially vertical and centered about major longitudinal axis A-A. The lateral sides 66*a*, 66*b* are configured to be substantially horizontal and centered about major lateral axis B-B. In operation, a package of compressed loosefill insulation material 50 is fed into the inlet portion 16 of the chute 14 in a manner such that the package 50 has a substantially vertical orientation. The term "vertical orientation", as used herein, is defined to a mean major face 52*a* of the package 50 extends along the longitudinal side 64*a*, opposing major face 52*b* extends along the substantially vertically-oriented bale guide 19, and opposing minor faces 54*a*, 54*b* of the package 50 are extend along the lateral sides 66*a*, 66*b*. Alternatively, the chute 14 can be configured such that the package 50 has a substantially horizontal orientation when fed into the inlet end 16 of the chute 14.

Figure 6A:
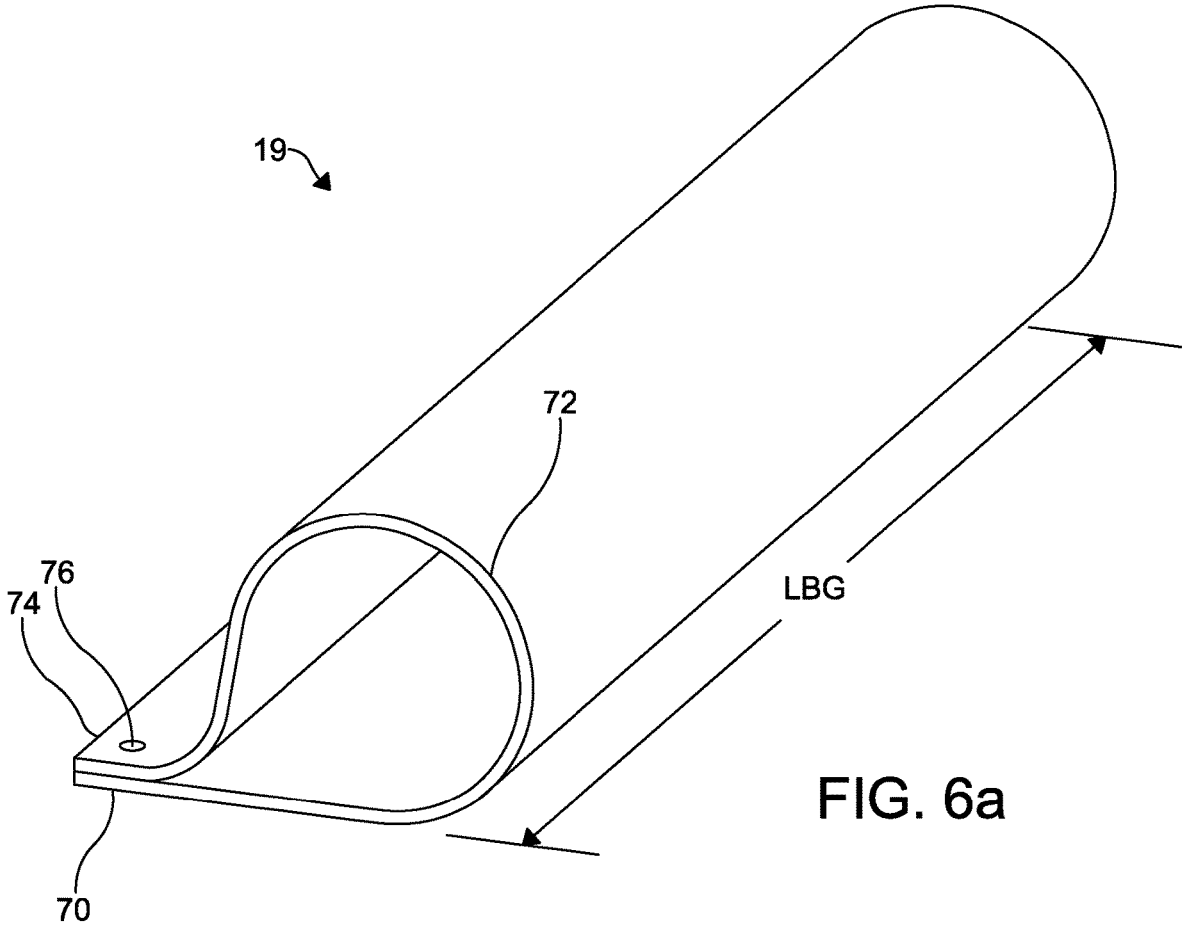
FIG. 6*a* is a perspective view of the bale guide of the loosefill insulation blowing machine of FIG. 1.
Figure 6B:
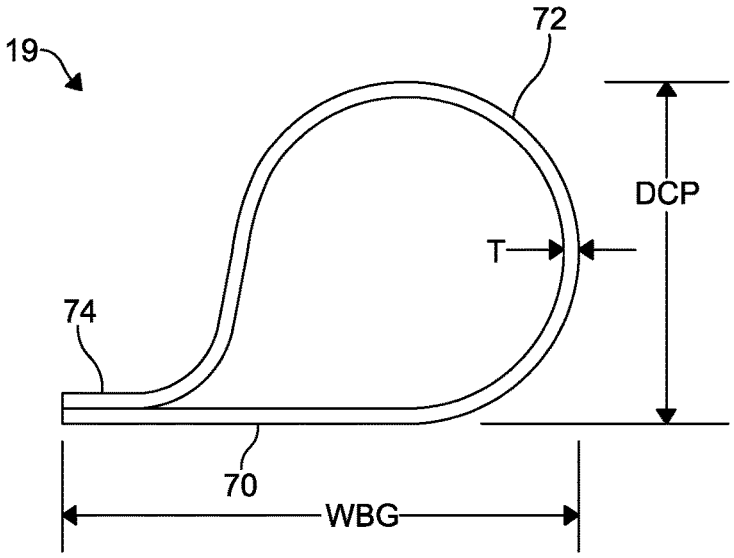
FIG. 6*b* is a side view, in elevation, of the bale guide of FIG. 6*a*.

Referring now to FIGS. 6*a* and 6*b*, the bale guide 19 is illustrated. The bale guide 19 is formed from one or more sheet materials having a thickness T. In the illustrated embodiment, the thickness T is approximately 0.125 inches. However, in other embodiments, the thickness T can be more or less than approximately 0.125 inches. The sheet material forming the bale guide 19 is configured to be flexible, thereby allowing the bale guide 19 to flex as the package 50 contacts the bale guide 19. In turn, the resilient nature of the bale guide 19 produces a force that urges the package 50 into contact with the cutting mechanism 20 as the package 50 progresses into the inlet end 16 of the chute 14. In the illustrated embodiment, the bale guide 19 is formed from a polymeric material having a low coefficient of friction that allows the package 50 to easily slide against the bale guide 19, such as for example, high density polyethylene (hdpe). However, in other embodiments, the bale guide 19 can be formed from other materials suitable to flexibly urge the package 50 into sliding contact with the cutting mechanism 20.

Referring again to FIGS. 6*a* and 6*b*, the bale guide 19 has a first flat portion 70, a curved portion 72 extending from the first flat portion 70 and a second flat portion 74 extending from the curved portion 72. The first and second flat portions 70, 74 are oriented in a stacked arrangement, thereby forming the curved portion 72. A plurality of apertures 76 (a single aperture is shown for purposes of clarity) extend through the first and second stacked flat portions 70, 74.

Figure 5:
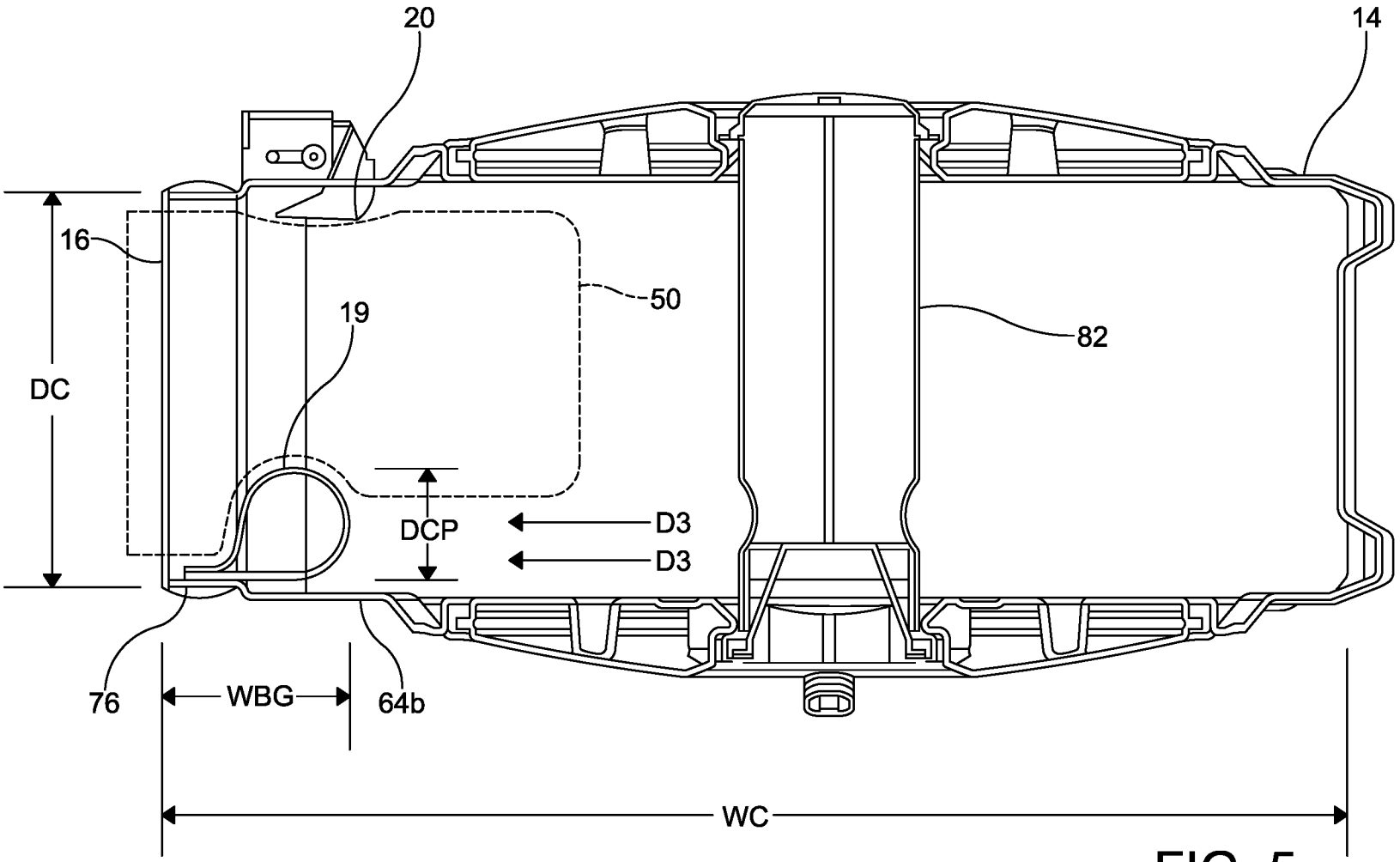
FIG. 5 is a plan view, in cross-section, of the chute of the loosefill insulation blowing machine of FIG. 1.

Referring now to FIGS. 4 and 5, a plurality of fasteners 76 is used to attached the bale guide 19 to the longitudinal side 64*b* of the inlet portion 16 of the chute 14 such that the curved portion 72 of the bale guide 19 is positioned downstream from the stacked first and second flat portions 70, 72. In the illustrated embodiment, the fasteners 76 are rivets. However, in other embodiments, the fasteners 76 can have other forms sufficient to attach the bale guide 19 to the longitudinal side 64*b* of the inlet portion 16 of the chute 14, including the non-limiting example of threaded fasteners.

Referring again to FIGS. 5 and 6*b*, the curved portion 72 of the bale guide 19 has a diameter DCP. The diameter DCP of the curved portion 72 is configured such that the curved portion 72 of the bale guide 19 extends across a depth DC of the inlet portion 16 of the chute 14 a distance sufficient to ensure engagement of the package 50 with the cutting mechanism 20. In the illustrated embodiment, the curved portion 72 has a diameter DCP in a range of from about 2.0 inches to about 3.0 inches and the depth DC of the inlet portion 16 is in a range of from about 8.0 inches to about 10.0 inches. Accordingly, the curved portion 72 of the bale guide 19 extends across approximately 20.0% to about 37.5% of the depth DC of the inlet portion 16 of the chute 14. Without being held to the theory, it is believed that a curved portion 72 having a larger diameter would hinder entry of the package 50 into the inlet portion 16 of the chute 14 and a curved portion 72 having a smaller diameter would provide insufficient engagement of the package 50 with the cutting mechanism 20.

Referring again to FIG. 5, as discussed above the curved portion 72 of the bale guide 19 extends across approximately 20.0% to about 37.5% of the depth DC of the inlet portion 16 of the chute 14. Advantageously, the extension of the bale guide 19 across the inlet portion 16 provides a retention structure (e.g. dam). The retention structure is useful to retain loosefill insulation material exiting the package 50 and expanding in a direction, as shown by direction arrows D3, toward the inlet portion 16 of the chute 14. The loosefill insulation material expanding in the direction D3 toward the inlet portion 16 of the chute 14 will be substantially retained within the chute 14 by the bale guide 19.

While the bale guide 19 is shown in FIGS. 6*a* and 6*b* as having a substantially circular cross-sectional shape, the bale guide 19 can have other cross-sectional shapes, such as for example a triangular cross-sectional shape. A triangularly-shaped bale guide could be oriented with the narrow portion of the triangle positioned near the inlet portion 16 of the chute 14 and a larger portion of the triangle arranged in a downstream direction.

Referring again to FIGS. 5 and 6*b*, the bale guide 19 is positioned at the inlet portion 16 of the chute and has a width WBG. The width WBG of the bale guide 19 is configured such that the bale guide 19 extends from the inlet portion 16 of the chute 14 into the chute 14 only a small distance compared to an overall chute width WC. In the illustrated embodiment, the width WBG of the bale guide 19 is in a range of from about 4.0 inches to about 6.0 inches and the width WC of the chute 14 is in a range of from about 32.0 inches to about 36.0 inches. Accordingly, the bale guide 19 extends into the chute 14 approximately 11.1% to about 18.8% of the width WC of the chute 14. Advantageously, positioning the bale guide 19 at the inlet portion 16 of the chute 14 and limiting the distance the bale guide 19 extends into the chute 14 provides more space within the interior of the chute 14 for the distribution hose 38 to be wound around the hub 82 with the machine 10 in a storage mode.

Referring again to FIGS. 4 and 6*a*, the bale guide 19 has a length LBG. The length LBG of the bale guide 19 is configured such that the bale guide 19 extends substantially across a height HIP of the inlet portion 16 of the chute 14. The term "substantially across", as used herein, is defined to mean the length LBG of the bale guide 19 is in a range of from about 70.0% of the height HIP of the inlet portion 16 of the chute 14 to about 100.0% of the height HIP of the inlet portion 16 of the chute 14. Without being held to the theory, it is believed the length LBG of the bale guide 19 of at least 70.0% of the height HIP of the inlet portion 16 of the chute 14 advantageously retains the package 50 in an upright orientation as the package 50 is slid into the inlet portion 16 of the chute 14 and subsequently engages the cutting mechanism 20. An upright orientation of the package 50 substantially prevents sagging of the package 50 as the package 50 moves past the cutting mechanism 20. It has been found that maintaining an upright orientation of the package 50 leads to more efficient expansion of the compressed loosefill insulation material as the compressed loosefill insulation material exits the package in a direction toward the shredding chamber 23. In the illustrated embodiment, the length LBG of the bale guide is about 15.0 inches and the height HIP of the inlet portion 16 of the chute 14 is about 21.0 inches. Accordingly, the length LBG the bale guide 19 is approximately 71.0% of the height HIP of the inlet portion 16 of the chute 14. However, in other embodiments, the length LBG of the bale guide 19 can be more than 71.0% of the height HIP of the inlet portion 16 of the chute 14.

The principle and mode of operation of the loosefill insulation blowing machine with a full height bale guide have been described in certain embodiments. However, it should be noted that the loosefill insulation blowing machine with a full height bale guide may be practiced otherwise than as specifically illustrated and described without departing from its scope.

What is claimed is:

1. A machine for distributing blowing loosefill insulation material from a package of compressed loosefill insulation material, the machine comprising:

a chute configured to receive the package of compressed loosefill insulation material, the chute having a depth, an inlet portion, an outlet portion, a bale guide and a cutting mechanism, the inlet portion configured to receive the package of compressed loosefill insulation material with the package having a substantially vertical orientation, the bale guide having a curved portion and the curved portion having a depth, a vertical orientation and configured to urge the package against the cutting mechanism as the package slides within the chute, the cutting mechanism configured to open the bag of insulation; and a lower unit configured to receive the compressed loosefill insulation material exiting the outlet portion of the chute, the lower unit including a plurality of shredders and a discharge mechanism, the discharge mechanism configured to discharge conditioned loosefill insulation material into an airstream;

wherein the depth of the curved portion of the bale guide extends across the inlet portion of the chute a distance of 20.0% to 37.5% of the depth of the inlet portion of the chute to form a retention structure configured to retain within the chute loosefill insulation material exiting the package and expanding toward the inlet portion of the chute.

2. The machine of claim 1, wherein the bale guide is positioned at the inlet portion of the chute.

3. The machine of claim 1, wherein the curved portion of the bale guide has a first flat portion extending therefrom and a second flat portion extending therefrom.

* * * * *